United States Patent [19]

Taylor

[11] 4,032,009

[45] June 28, 1977

[54] CONTAINER SYSTEM FOR GARAGE DOOR OPENER

[75] Inventor: Robert E. Taylor, Evanston, Ill.

[73] Assignees: Robert E. Taylor; Aaron M. Schmidt, both of Chicago, Ill.

[22] Filed: Feb. 11, 1976

[21] Appl. No.: 657,051

[52] U.S. Cl. ..... 206/321; 206/523

[51] Int. Cl.[2] ..... B65D 81/04

[58] Field of Search ..... 206/223, 319, 320, 321, 206/523; 229/37 R, 27

[56] References Cited

UNITED STATES PATENTS

| | | | |
|---|---|---|---|
| 2,720,964 | 10/1955 | Hopper | 206/223 |
| 3,625,411 | 12/1971 | Cote | 229/37 R |
| 3,672,492 | 6/1972 | Sherr | 206/321 |

*Primary Examiner*—Donald F. Norton
*Attorney, Agent, or Firm*—George H. Gerstman

[57] ABSTRACT

A compact container system which utilizes minimal storage space is provided for packaging and shipment of an electric garage door opener. Among the many components of the container system is a corrugated cardboard shipping carton for snugly holding the motor unit or power opener head of the garage door opener. One of the sidewalls of the shipping carton includes an access flap for the optional insertion of an auxiliary transmitter.

10 Claims, 18 Drawing Figures

106
86
104
68
106
105
28
142
144
76
82
84
78
26
A
32
B
194
174
24
52
30
72
22
60
38
42
56
52
54
54
52
1b
1b
68
86
52
58
122
118
5
136
138
139
108
140
5
110
132

CONTAINER SYSTEM FOR GARAGE DOOR OPENER

BACKGROUND OF THE INVENTION

This invention relates to corrugated cardboard cartons, and more particularly, to a container system for packaging and shipping garage door openers.

Garage door openers are typically supplied in a multitude of parts for assembly in the consumer's garage. These parts typically include a bulky motor unit, elongated rails, one or more various-sized receivers, at least one transmitter, a trolley or spring, a chain, a control arm and an assortment of bolts. The garage door opener may be packaged and shipped in a multitude of carbons, but this is expensive, wastes space, causes additional strain on inventory control and requires additional labor for loading and receiving. One or more enlarged oversized cartons may be used to package the parts of the garage door opener, but this results in a bulky carton which is difficult to handle, requires an inordinate amount of valuable storage space and is expensive to manufacture.

SUMMARY OF THE INVENTION

It is an object of this invention to provide an inexpensive and relatively simple container system for packaging a garage door opener.

Another object of this invention is to provide a compact storage system for a garage door opener which is easy to handle, transport and manufacture.

In accordance with the present invention, a compact container system is provided for holding an electric garage door opener. In the illustrative embodiment, the container system includes a variable capacity container, a twin compartment container and a corrugated cardboard carton. The variable capacity container includes an elongated compartment with a plurality of pocket flaps movable from an inward position partially blocking the interior of the compartment to enable the compartment to hold a first-sized receiver to an outward position avoiding blockage of the compartment to enable the compartment to hold a larger-sized receiver. The variable capacity container further has a plurality of integrally hinged flaps defining a transmitter cavity at one end of the compartment for holding a primary transmitter.

In the illustrative embodiment, the twin compartment container is constructed and arranged to provide two adjacent elongated compartments with the first compartment adapted to hold the variable capacity container and the second compartment adapted to hold a lens for covering a light bulb.

In the illustrative embodiment, the corrugated cardboard carton is larger than the twin compartment container and includes a plurality of integrally hinged equal height panels for snugly holding both the twin compartment container and a motor unit of the garage door opener in side-by-side relationship.

In the illustrative embodiment, one of the panels of the carton includes an access flap for accommodating optional insertion of an auxilliary transmitter into the interior of the carton. A top access flap may be provided in one of the upper flaps of the carton to accommodate a carrying handle.

The container system can further include an elongated cardboard carton for holding an overhead rail of the garage door opener. The elongated carton preferably is equipped with a handle and is reinforced by a cardboard support structure.

A more detailed explanation of the invention is provided in the following description and appended claims taken in conjunction with the accompanying drawings.

BRIEF DESCRIPTION OF THE DRAWINGS

FIG. 1-A illustrates the top perforated access flap in a closed position preventing access to the carrying handle;

FIG. 1-B illustrates the top access flap in an open position permitting access to the carrying handle;

DETAILED DESCRIPTION OF THE ILLUSTRATIVE EMBODIMENT

Figures 1, 1A, 1B, 2, 3:
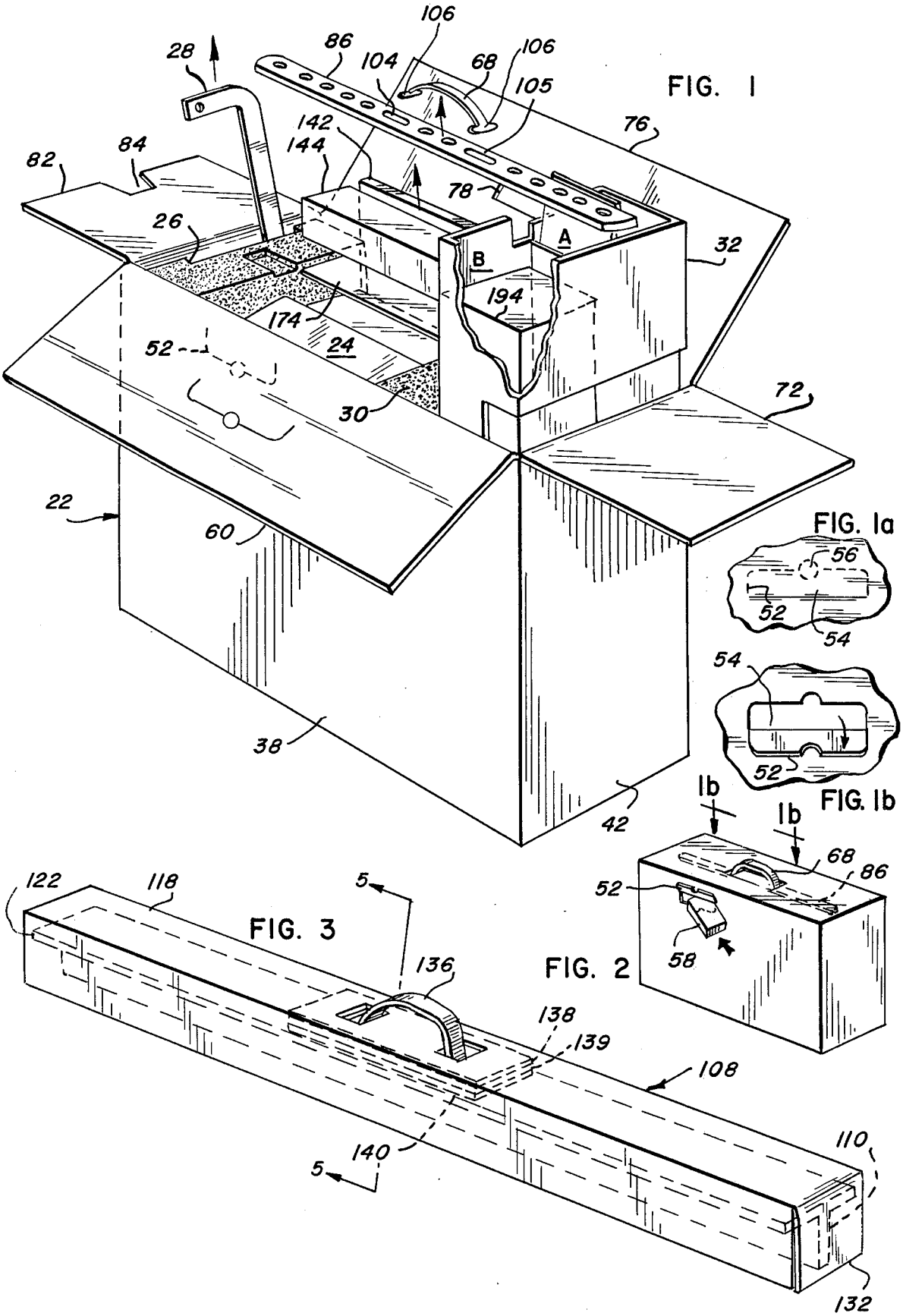
FIG. 1 is a partially exploded perspective view of a container system for a garage door opener, in accordance with the principles of the present invention.
FIG. 2 is a reduced perspective view of the container system ready for shipment with a side access flap opened for insertion of an auxiliary transmitter.
FIG. 3 is a perspective view of a carton for an elongated overhead rail.

Referring to the drawings, a container system 20 for packaging and shipping a remote-controlled electric garage door opener includes a corrugated cardboard shipping carton or box 22. The length and width of the box are chosen to compactly store a motor unit or power opener head 24 of a typical electric garage door opener. The ends of the motor unit are each firmly held in the box by a Styrofoam insert approximating the height and width of the box, with one Styrofoam insert 26 abutting an end of the box and shaped to securely receive a U-shaped metal control arm 28 of the garage door opener, and with the other Styrofoam insert abutting the inward end of a two-cavity twin-compartment container 32, which abuts against the other end of the box.

Figure 4:
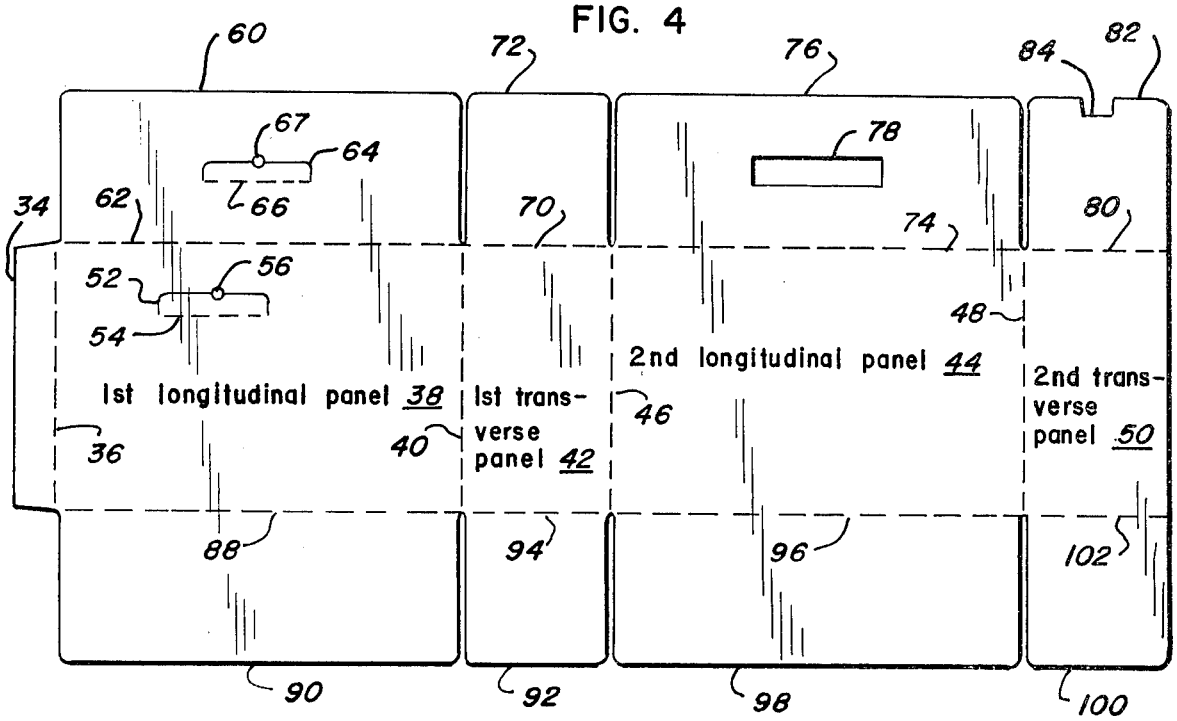
FIG. 4 is a plan view of a blank or web from which the outer external carton of FIG. 1 is formed.
Figure 5:
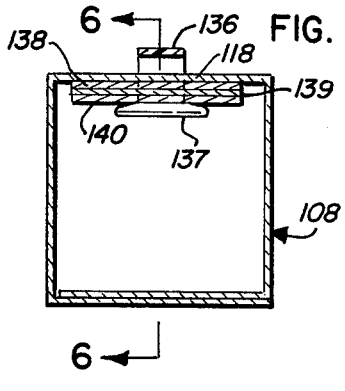
FIG. 5 is a cross-sectional view of the carton of FIG. 3 taken along the line 5—5 of FIGS. 3 and 6.
Figure 6:
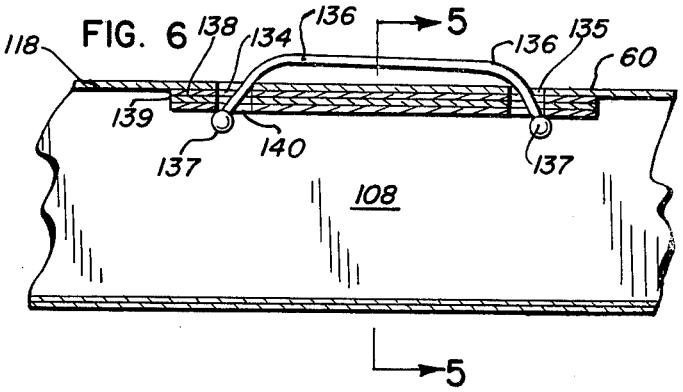
FIG. 6 is a longitudinal cross-sectional view of the carton of FIG. 3 taken along the line 6—6 of FIG. 5.

As best shown in FIG. 4, the box 22 includes an end glue flap 34 integrally hinged along a first vertical score line 36 to a first rectangular, longitudinal panel 38. One end of the first longitudinal panel is integrally hinged along a second vertical score line 40 to a first rectangular, transverse panel 42. A second rectangular, longitudinal panel 44 is integrally hinged along a third vertical score line 46 to the other end of the first transverse panel. The opposite end of the second longitudinal panel is integrally hinged along a fourth vertical score line 48 to a second rectangular transverse panel 50. When box 22 is erected, the glue flap is bonded to the interior of the second transverse panel.

The first longitudinal panel 38 is perforated to provide an upwardly-extending side access flap 52 along an interior horizontal score line 54. A removable perforated thumb-sized circular spacer 56 may be provided along the top middle edge of the side flap so as to permit the side access flap to be pulled outward to define an access opening for inserting a paperboard box containing an auxiliary transmitter 58 into the interior of the box 22 as best shown in FIG. 2, for placement on top of the motor unit 24. Once the auxiliary transmitter is inserted into the box 22, the side flap may be closed to lie flush with the rest of the first longitudinal panel. When the circular spacer is removed, a semi-circular finger-graspable edge is formed along the top of the side access flap. The side access flap and circular spacer need not be open when an auxiliary transmitter is not to be provided with the electric garage door opener. The height of the box should be slightly larger than the height of the motor unit to provide room for the auxiliary transmitter.

A first upper rectangular flap 60 integrally extends above the first longitudinal panel 38 along a first upper horizontal score line 62. The first upper flap is perforated to provide a top access flap 64 along an upper interior horizontal score line 66. A removable finger-sized perforated circular spacer 67 may also be provided adjacent the top edge of the top flap so that the top flap may be pulled upward for access to a flexible plastic handle 68. The top flap operate similarly to the side access flap 52 and is offset slightly longitudinally therefrom.

Extending above the first transverse panel 42 along a second upper horizontal scoreline 70 is a first upper rectangular transverse flap 72. Extending above the second longitudinal panel 44 along a third upper horizontal score line 74 and spaced from the first upper rectangular transverse flap is a second upper rectangular longitudinal flap 76. The second upper longitudinal flap is arranged to fold under the first upper longitudinal flap 60 and is shaped to provide a rectangular aperture 78 for alignment below the top access flap 64 to permit accessibility to the handle 68. Extending above the second transverse panel 50 along a fourth upper horizontal score line 80 and spaced from the second upper longitudinal flap is a second upper transverse flap 82. A U-shaped channel or notch 84 is provided along the top edge of the second upper transverse flap so as to avoid interfering with the elongated apertured metal bar 86 of the garage door opener. Each of the upper flaps are horizontally spaced from each other so that the flaps may be closed when the garage door opener is inserted into box 22.

Extending beneath the first longitudinal panel 38 along a first lower horizontal score line 88 is a first lower longitudinal flap 90. A first lower rectangular transverse flap 92 extends beneath the first transverse panel 42 along a second lower horizontal score line 94. Extending beneath the second longitudinal panel 44 along a third lower horizontal score line 96 is a second lower rectangular longitudinal flap 98. A second lower rectangular transverse flap 100 integrally extends along a fourth lower horizontal score line 102 from the second transverse panel 50. Each of the lower or bottom flaps are horizontally spaced from each other so that they may be bent inward to provide the bottom of the box 22. The upper and lower flaps are all of the same height.

Each of the Styrofoam inserts 26 and 30 is recessed along its top so that the apertured bar 86 sits flush along the top of the Styrofoam inserts. The apertured bar of the garage door opener is modified to include two oblong slots 104 and 105 for receiving the handle 68. An enlarged arcuate section 106 is provided at each end of the handle and is of a width to prevent the handle from being removed from the apertured bar. The maximum spacing between the ends of the oblong slots are such that the handle lies almost flat against the apertured bar when not being used. The minimum spacing between the interior end of the oblong slots are such that the handle may be pulled upward to form an arc for permitting insertion of a hand along the underside of the handle. The width of each oblong slot is greater than the thickness of the handle to permit the handle to be coupled to the apertured bar.

Figure 7:
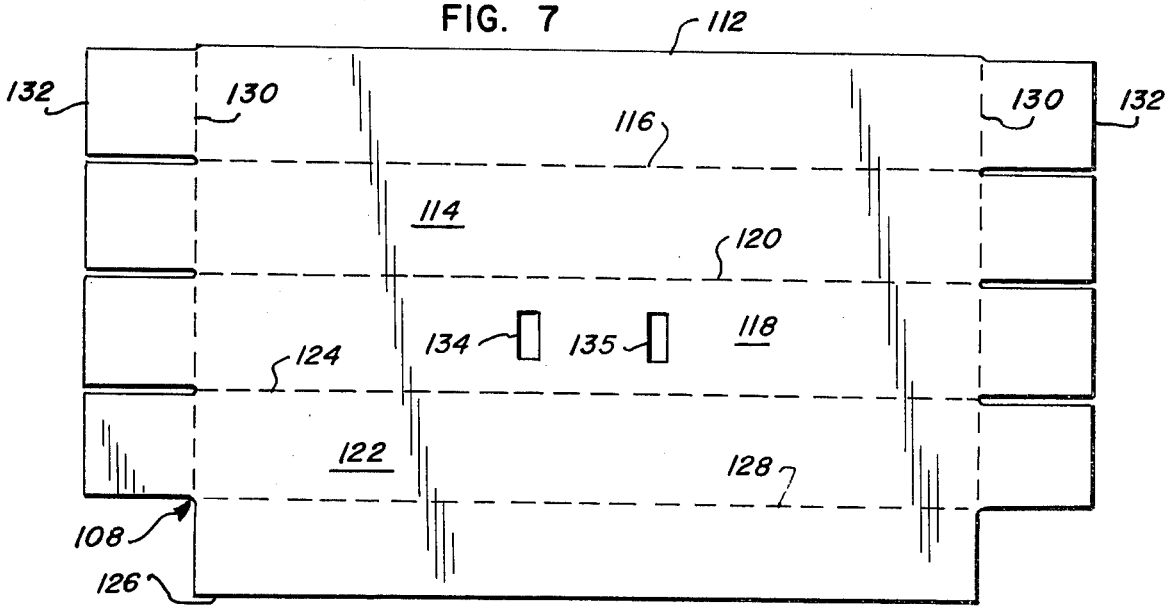
FIG. 7 is a plan view of a blank or web from which the cardboard carton of FIG. 3 is formed.

The container system 20 may also include an elongated cardboard carton or box 108 for snugly packaging an elongated T-shaped overhead rail 110 as best shown in FIG. 3. While the elongated carton is preferably constructed of 205 pound test corrugated cardboard, other cardboard having a different pound test (strength) may also be used as desired. As best shown in FIG. 7, the elongated carton includes five equal size elongated panels with a first elongated panel 112 integrally hinged to a second elongated panel 114 along a first elongated score line 116. A third elongated panel 118 is integrally connected along a second elongated score line 120 to the second elongated panel and is also integrally hinged to a fourth elongated panel 122 along a third elongated score line 124. The fourth panel is hinged to a fifth elongated panel via a fourth elongated score line 128.

Each end of each of the first, second, third and fourth elongated panels of the elongated box 108 is integrally hinged along a vertical score line such as 130 to a separate end flap such as 132. The end flaps are substantially equal in size and are spaced slightly from each other to permit the elongated carton to be readily assembled and folded for shipping.

The third elongated panel 118 of box 108 is punched to provide two rectangular longitudinally aligned apertures 134 and 135 for accommodating a second flexible plastic handle 136. Three rectangular equal size cardboard inserts 138, 139 and 140 are sandwiched together to provide a laminated support structure on the underside of the third elongated panel. The laminated structure is also punched to provide rectangular openings in vertical alignment with the rectangular apertures 134 and 135. The ends 137 of the second handle 136 are similar to handle 68 so as to securely hold the handle on the underside of the laminated support structure while being of a width slightly less than the length of the rectangular aperture to permit ease of installation and assembly. The laminated structure functions to prevent wear and deformation of the third elongated panel when the elongated carton is being lifted by the handle. When desired the support structure may be formed from a cardboard panel scored to provide three integrally hinged sections.

It can be seen from FIG. 3, that when the elongated carton is assembled for packaging and shipping, the third elongated panel becomes the top panel and the first and fifth panels are sandwiched against each other to provide a double layer bottom panel.

Referring again to FIG. 1, a narrow rectangular thin-walled container 142 can be inserted vertically between the motor unit or opener head 24 and the back sidewall of the shipping carton 22 formed by the second longitudinal panel 44. The narrow container can be made of cardboard or the like and is preferably used for containing the chain of the electric garage door opener.

An elongated thin-walled cardboard box 144 containing a trolley or spring of the garage door opener fits snugly between the Styrofoam inserts 26 and 30. The elongated thin-walled box is adapted to be seated on top of the opener head 24 and is of a height to be positioned slightly beneath the top flap of shipping carton 22.

The two cavity twin-compartment container 32 shown in FIGS. 8–11 has a plurality of elongated rectangular vertical panels including a first vertical panel 146 integrally hinged along a first vertical score line 148 to a second vertical panel 150. The second vertical panel is somewhat shorter than the first vertical panel and is integrally hinged to an upper rectangular flap 152 along a horizontal score line 154. The combined height of the second vertical panel and the upper rectangular flap exceeds the height of the first vertical panel. A third vertical panel 156 is integrally connected to the second vertical panel along a second vertical score line 158. A section of the upper edge 160 of the third vertical panel, that lies adjacent the second vertical panel, is of a lesser height than the remainder of the third vertical panel. A fourth vertical panel 162 has one end integrally connected to the third vertical panel along a third vertical score line 164 and has its other end integrally connected to a fifth vertical panel 166 along a fourth vertical score line 168.

The fifth vertical panel 166 of the two cavity twin-compartment container 32 is much wider than the other vertical panels and has peripheral dimensions slightly less than the end wall of the shipping carton 22 formed by the first transverse panel 42 for positioning there against as shown in FIG. 1. The fifth vertical panel defines a middle panel which provides an end wall for the two cavity twin-compartment container.

Figure 8:
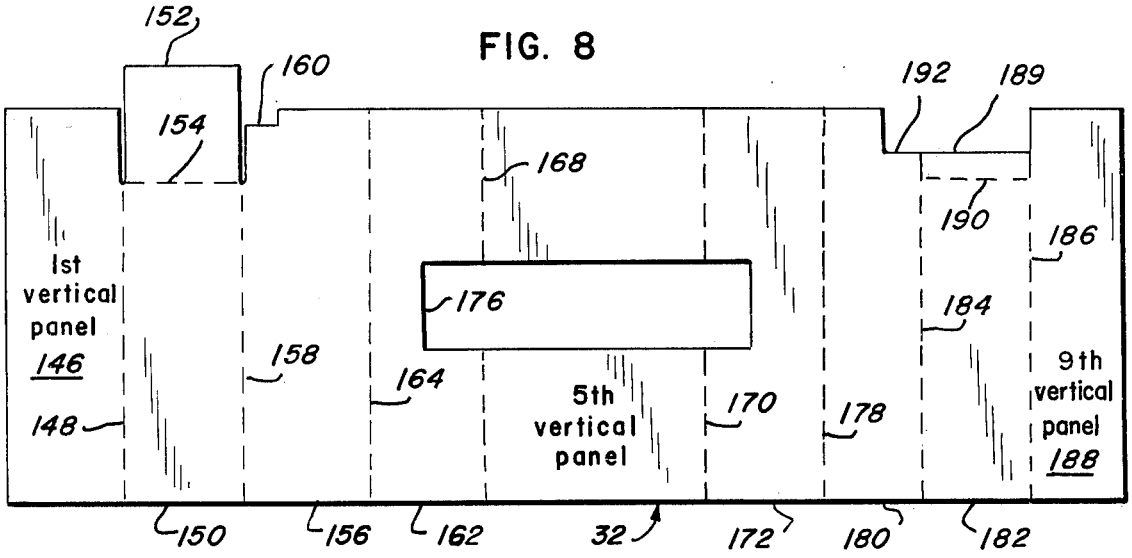
FIG. 8 is a plan view of a blank or web from which a two-cavity twin compartment container is formed for holding a receiver and photoelectric lens.

One end of the fifth vertical panel 166 of the two cavity twin-compartment container 32 is integrally hinged along a fourth vertical score line 170 to a sixth vertical panel 172. The sixth vertical panel is of the same size as the fourth vertical panel. An elongated, rectangular section or reinforcing pad 174 is removed from the two cavity twin-compartment container 32, leaving a rectangular opening or cutaway 176 spanning across the fourth, fifth and sixth vertical panels as best shown in FIG. 8. The elongated rectangular section 174 is of a length slightly less than the distance between the styrofoam inserts 26 and 30 and is adapted to be positioned beneath the cardboard box 144 and upon the motor unit, or opener head 24, as shown in FIG. 1. Section 174 aids in preventing the parts in box 144 from scratching the motor unit or from preventing any outstanding members on the motor unit from damaging box 144. The width of section 174 is slightly less than the width of the elongated thin-walled box 144.

Integrally hinged to the sixth vertical panel 172 of the two cavity twin-compartment container 32, along a fifth vertical score line 178 is a seventh vertical panel 180. An eighth vertical panel 182 is integrally connected along a sixth vertical score line 184 to the seventh vertical panel and is integrally connected at its opposite end along a seventh vertical score line 186 to a ninth vertical panel 188. The maximum height of the first, third, fourth, fifth, sixth, seventh and ninth vertical panels is substantially equal. The eighth vertical panel is somewhat shorter than the ninth vertical panel and is about the same height as the second vertical panel 150. A second upper rectangular flap 189 is integrally hinged along a second upper score line 190 to the upper end of the eighth vertical panel. The second upper score line is in substantial horizontal alignment with the horizontal score line 154. The upper corner 192 of the seventh vertical panel 180, adjacent the eighth vertical panel 182, is in horizontal alignment with the upper edge of the second upper flap 189 and is of a lesser height than the remainder of the seventh vertical panel.

Figure 9:
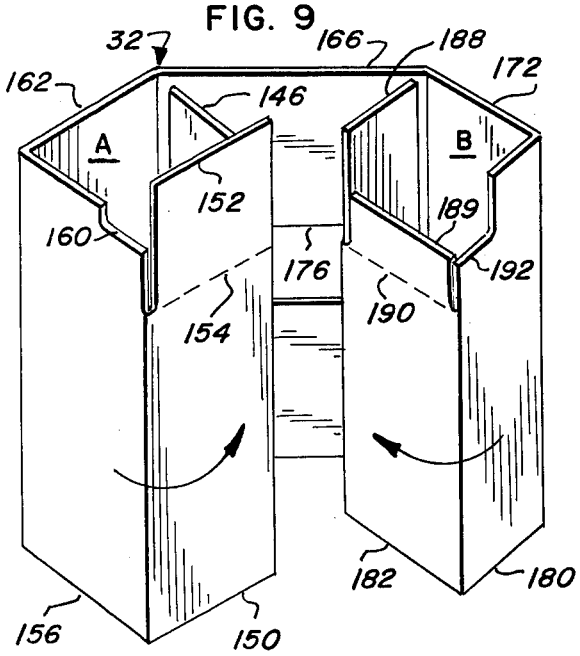
FIG. 9 is a perspective view of the two cavity twin compartment container in a partially open position.
Figure 11:
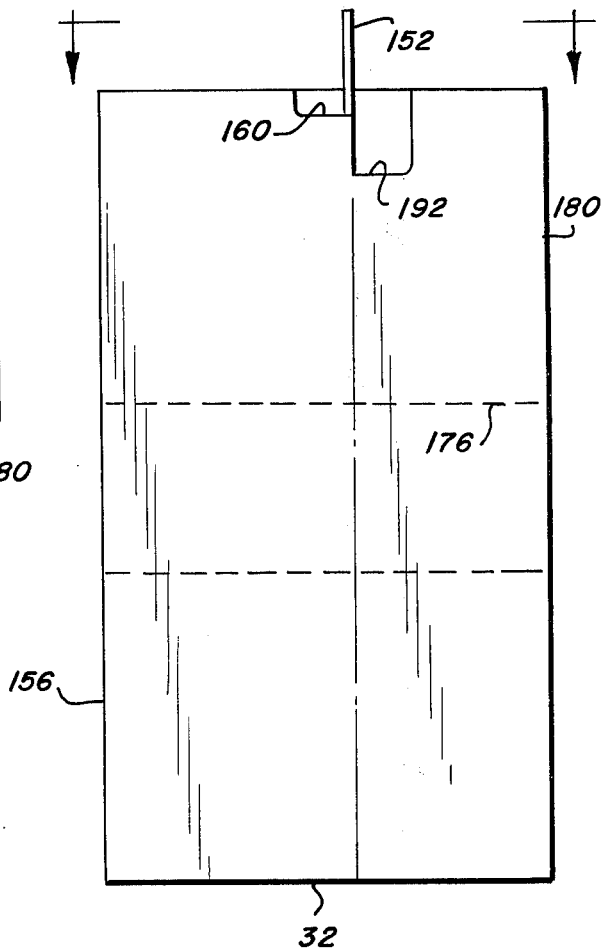
FIG. 11 is a side view of the two cavity twin compartment container shown in FIG. 10.
Figure 10:
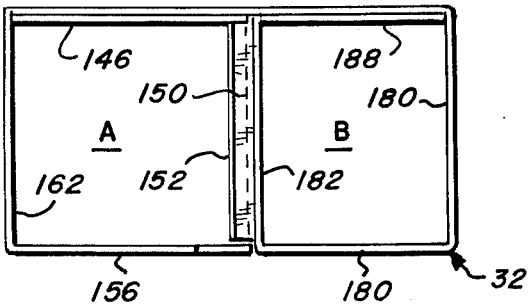
FIG. 10 is a top view of the two cavity twin compartment container in a closed assembled position.
Figure 14:
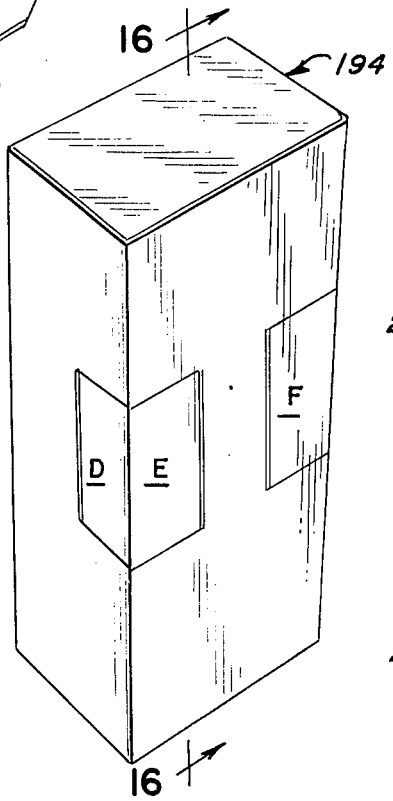
FIG. 14 is a perspective view of the variable size cardboard carton with the side flaps in an outward position for receiving a larger receiver.

To assemble the two cavity twin-compartment container 32, the first and ninth vertical panels 146 and 188, respectively, are rotated inward toward the fifth or middle vertical panel 166 as shown in FIG. 9. When fully assembled, the first and ninth vertical panels are positioned against the fifth vertical panel to block the window 176 defined in the middle panel 166 and the second and eighth vertical panels 150 and 182 are positioned against each other in side-by-side relationship as best shown in FIG. 10 with the third and seventh vertical panels 156 and 180, positioned flush in general horizontal alignment so as to provide an end wall across from the fifth vertical panel 166. The first, second, third and fourth panels provide a first elongated tubular compartment A of rectangular cross-section, while the sixth, seventh, eighth and ninth vertical panels provide a second compartment B of rectangular cross-section. The interior cross-sectional area of the first compartment is slightly larger than the interior cross-sectional area of the second compartment B. The larger, first compartment A defines a lens cavity for receiving a box containing a lens for covering the garage door opener's lamp bulb. The smaller second compartment B defines a receiver cavity for receiving a variable-sized cardboard carton or box 194 containing the radio receiver of the garage door opener as illustrated in FIG. 14. Once the boxes containing the lens and receiver are inserted into the first and second compartments, respectively, the upper flap 152 and 189 are moved into general horizontal alignment blocking the interiors of the first and second compartments so as to provide a support surface for supporting a key switch and a plastic bag containing an assortment of bolts and other miscellaneous small parts of the garage door opener. After the two cavity twin-compartment container 32 has been inserted in the shipping carton 22, the upper corner 160 of the third vertical panel is disposed in general horizontal alignment with the top recessed portion of the middle styrofoam insert 30 for supporting the apertured bar 86.

Referring to FIGS. 12–16, the container or box 194 containing the receiver is preferably made of thin-walled shirtboard, however, cardboard or other material may be used as desired. The receiver-containing box 194 includes a first rectangular panel 198 integrally hinged along a first vertically elongated score line to a second rectangular panel 202. A third rectangular panel 204 has one side integrally hinged along a second vertical elongated score line to the second rectangular panel, and has its opposite side vertically hinged along a third vertically elongated score line 208 to a fourth rectangular panel 210. Integrally connected to one end of the fourth rectangular panel along a fourth vertical elongated score line 212 is a fifth rectangular panel 214. A sixth rectangular panel 216 has one end integrally connected along a fifth vertically elongated score line 218 to the fifth rectangular panel and has its other elongated end integrally connected along a sixth vertically elongated score line 220 to a seventh rectangular panel 222.

Figure 12:
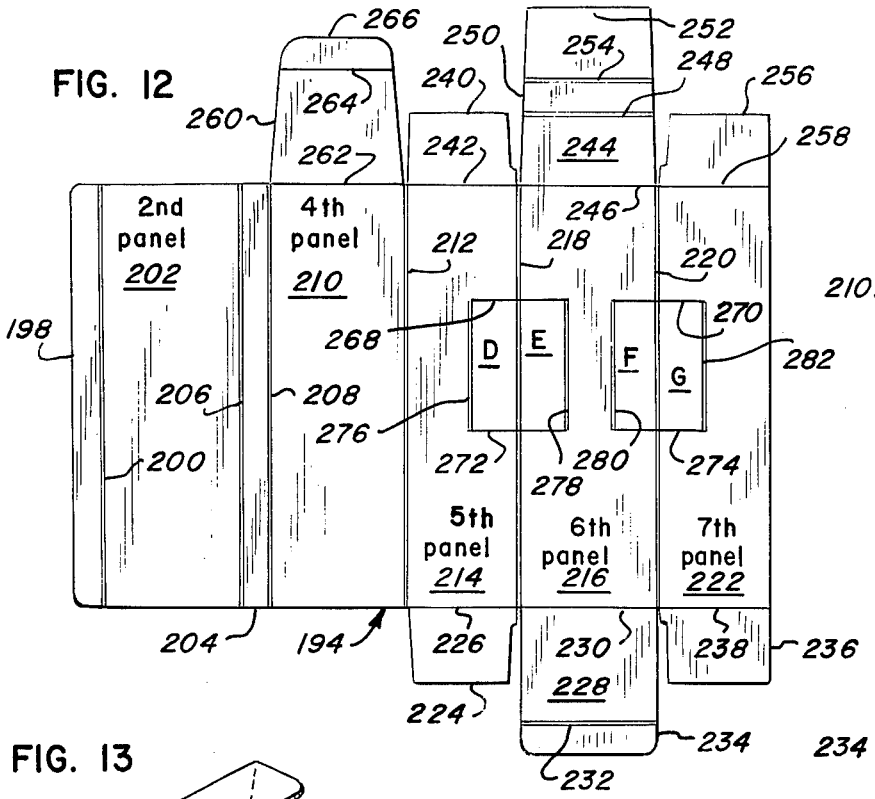
FIG. 12 is a plan view of a blank or web from which a variable size cardboard carton is formed for holding various sized receivers.
Figure 15:
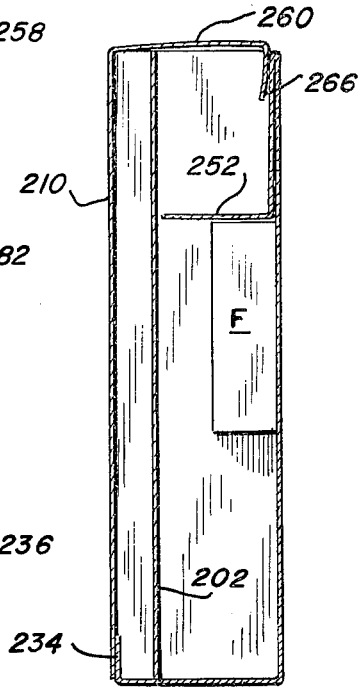
FIG. 15 is a cross-sectional view of the carton shown in FIG. 13 with the top flaps closed, taken along the line 15—15 of FIG. 13.

As best shown in FIG. 12, the receiver-containing carton 194 includes a first lower transverse flap 224 integrally hinged to the fifth panel 214 along a first horizontal bottom score line 226. A bottom flap 228 has its upper end integrally hinged along a second horizontal bottom score line 230 to the sixth panel 216 and has its bottom end integrally hinged along a lower horizontal score line 132 to a rounded edged flap 234. A fourth bottom flap 236 is integrally connected along a third horizontal bottom score line 238 to the seventh panel. The first, second and third horizontal bottom score lines generally lie in a common plane.

The receiver-containing carton 194 further includes a first upper transverse flap 240 integrally hinged along a first upper horizontal score line 242 to the upper end of the fifth panel. A first upper flap 244 has its lower end integrally hinged along a second upper horizontal score line 246 to the upper end of the sixth panel, and has its upper edge integrally hinged along a third upper horizontal score line 248 to a second upper flap 250. A third upper flap 252 is integrally connected along a fourth upper horizontal score line 254 to the upper edge of the second upper flap. A second upper transverse flap 256 has its lower edge integrally connected along a fifth upper score line 258 to the top end of the seventh panel 222. It can be seen from FIG. 12 that the first, second and fifth upper horizontal score lines lie in a common horizontal plane, while the third upper score line 248 lies in a common horizontal plane with the top edges of flaps, 240 and 256, respectively. A top flap 260 has its lower end integrally hinged along a sixth upper horizontal score line 262 to the top of the fourth panel 210, while its upper edge is integrally connected along a seventh upper horizontal score line 264 to a rounded edge top flap 266.

Figure 13:
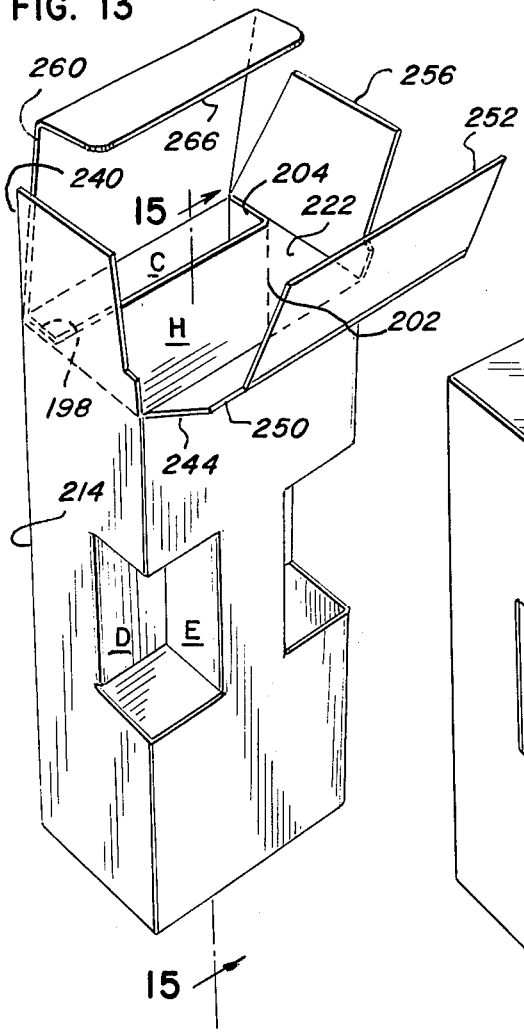
FIG. 13 is a perspective view of the variable size cardboard carton with the side flaps pushed inward and the top flap opened for receiving a relatively small receiver.
Figure 16:
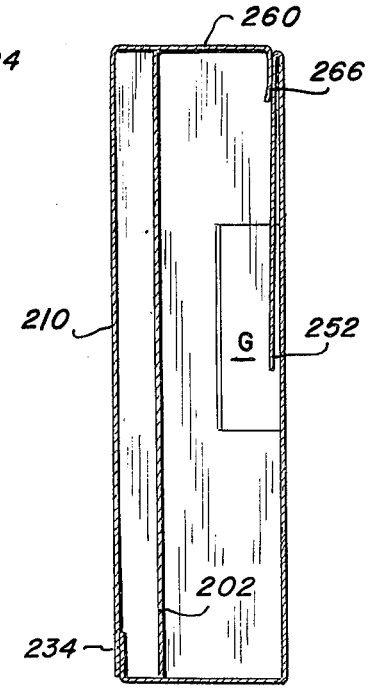
FIG. 16 is a cross-sectional view thereof, taken along the line 16—16 of FIG. 14.

The edges of flaps 240 and 256, respectively, which face toward flap 244 above the sixth panel 216 are tapered upward to provide a mouth for receiving the rounded edge top flap 266 when the upper flaps are folded over to form the top of the carton as shown in FIGS. 13 and 16. Similarly, the edges of the first and fourth bottom flaps 224 and 236, respectively, which face toward the second bottom flap 228 below the sixth panel 216 are tapered so as to provide a mouth for receiving the rounded edge third bottom flap 234 when the bottom flaps are folded over so as to provide the bottom of the receiver-containing carton 194.

The second, fourth and sixth panels of the receiver-containing carton 194 are of the same size, with the fourth and sixth panels 210 and 216, respectively, providing the end walls of the receiver-containing carton. The fifth and seventh panels are of the same size and provide the sidewalls of the receiver-containing carton. The first and third panels are of the same size and cooperate with the second and fourth panels to provide an elongated compartment or cavity C for holding an antenna, clips and related accessories of the garage door opener. When assembled, the first panel is bonded or sewn to the interior surface of the fifth panel 214, while the third panel 204 is bonded to the interior surface of the seventh panel 222.

The fifth, sixth and seventh panels of the receiver-containing carton 194 are cut along first and second upper horizontal severing lines 268 and 270, respectively, and along first and second lower horizontal severing lines 272 and 274. The first upper and lower severing lines are positioned in vertical alignment with respect to each other, while the second upper and lower severing lines are positioned in vertical alignment with respect to each other. Furthermore, the upper horizontal severing lines lie in a common plane, while the lower horizontal severing lines lie in another common plane.

The edges of the first upper and lower severing lines are connected along the fifth panel by a first exterior vertical score line 276, and are connected along the sixth panel by a second exterior vertical score line 278. The second upper and lower severing lines are connected along the sixth panel by a third exterior vertical score line 280 and along the seventh panel by a fourth exterior vertical score line 282. A first rectangular pocket flap D is defined in the fifth panel and bounded by the first upper severing line 268, the first exterior vertical score line 276, the first lower severing line 272 and the fifth vertical elongated score line 218 which is scored both interiorly and exteriorly along the first rectangular pocket flap. A second rectangular pocket flap E is defined in the sixth panel adjacent the first rectangular pocket flap along the fifth vertical elongated score line 218, and is bounded by the first upper and lower score lines as well as the second exterior vertical score line 278 and the fifth vertical elongated score line 218.

A third rectangular pocket flap F is defined in the sixth panel and bounded by the second upper severing line 270, the third exterior vertical score line 280, the second lower severing line 274, and the sixth vertical elongated score line 220 which is also interiorly and exteriorly scored along the third rectangular pocket flap. A fourth rectangular pocket flap G is provided in the seventh panel 222 adjacent the third rectangular pocket flap F along the sixth vertical elongated score line 220 and is bounded by the second upper and lower severing line as well as the fourth exterior vertical score line 282 and the sixth vertical elongated score line 220.

The rectangular pocketflaps D, E, F and G are all of the same size. A feature of the receiver-containing carton 194 is the ability of the first and second rectangular pocket flaps D and E to be pushed inward into the interior of the carton, as well as the ability of the third and fourth rectangular pocket flaps F and G to be pushed into the interior of the carton. These pockets extend about halfway into the interior of the carton between the front wall defined by the sixth panel 216 and the front wall of compartment C defined by the second panel 202.

A second elongated compartment, or cavity H, is defined by the area bounded by the second, fifth, sixth and seventh panels. Compartment H is separated from compartment C by a wall defined by the second panel. When the pockets D, E, F and G are pushed inward, the pockets block the interior of compartment H so that compartment H can snugly receive a relatively small standard garage-door radio receiver below the pockets. When the pockets are pushed outward to lie flush with the front end wall defined by the sixth panel 216 and the sidewalls defined by the fifth and seventh panels 214 and 222, respectively, compartment H becomes unblocked to receive a relatively large elongated garage door radio receiver. Thus, the pockets may be popped in or out of the carton so as to provide a variable sized carton 194 for receiving different sized receivers.

Flaps 244, 250 and 252 can be folded downward into compartment H to provide a transmitter cavity for receiving a primary garage door radio transmitter which may lie above the receiver. If the receiver is large enough to occupy the entire space of compartment H, the transmitter will be packed elsewhere. When desired flaps 244, 250 and 252 may be vertically aligned against the sixth panel 216 to permit even a larger receiver in compartment H. The rectangular cross-sectional area of the variable sized carton 194 should be such as to snugly and slidably fit within compartment B of shipping carton 22.

The container system of the present invention has many advantages:

1. The unique design and construction of the system substantially avoids wastage of material providing economy of manufacture.
2. The container system is constructed of lightweight material so as to minimize the shipping weight of the garage door opener.
3. The container system is compact so as to occupy the minimal amount of storage space.
4. The container system makes it relatively easy to carry and transport the electric garage door opener.
5. The design and construction of the container system accommodates different sized receivers and provides for optional insertion of an auxilliary transmitter.

Although an embodiment of the invention has been shown and described, it is to be understood that various modifications and substitutions may be made by those skilled in the art without departing from the novel spirit and scope of the invention.

What is claimed is:

1. A compact container system for holding components of a remote controlled electric garage door opener, comprising, in combination:

a. a variable capacity container for holding at least one of a transmitter and a receiver;

b. a twin compartment container including a first compartment and a second compartment for holding the variable capacity container; and c. a corrugated cardboard carton having a plurality of hinged panels defining end walls and sidewalls for snugly holding both a motor unit and the twin compartment container generally in adjacent relationship.

2. A container system as in claim 1, wherein one sidewall of the carton includes an access flap for accommodating optional insertion of an auxilliary transmitter into the interior of the carton.

3. A container system as in claim 2, wherein the height of the sidewalls is greater than the vertical distance of the motor unit when positioned in the carton to permit the auxilliary transmitter to be positioned upon the motor unit, said container system further including an elongated thin-walled box adapted to be positioned on top of the motor unit for holding a spring or trolley.

4. A container system as in claim 1, wherein the height of the sidewalls is greater than the vertical distance of the motor unit when positioned in the carton to permit the auxiliary transmitter to be positioned upon the motor unit.

5. A compact container system for holding components of a remote controlled electric garage door opener, comprising, in combination:

a. a first container for holding at least one of a transmitter and a receiver;

b. a twin compartment container including a first compartment and a second compartment adjacent the first compartment for holding the first container;

c. a corrugated cardboard carton for holding both a motor unit and the twin compartment container generally in side-by-side relationship; and d. an apertured elongated bar comprising part of the garage door opener for positioning in the carton above the motor unit and defining two oblong slots, a flexible handle coupled to the apertured bar with endwise sections slidably receivable in the oblong slots, the carton including an upper longitudinal panel hinged to one of the sidewalls and defining an elongated aperture for positioning in vertical alignment above the handle so that the handle may be extended above the carton for ease of handling.

6. A container system as in claim 5, wherein the carton further includes a longitudinal upper flap having a top access flap adapted to be positioned in vertical alignment above the elongated aperture for optional accessibility of the handle.

7. A container system as in claim 5, further including a first insert abutting an end wall of the carton for snugly holding one end of a motor unit to be located in the carton, a second insert interposed between the motor unit and the twin compartment container for snugly holding the other end of the motor unit, the first and second inserts having recessed top portions for receiving the apertured bar, a rectangular thin-walled container adapted to be positioned between the motor unit and a sidewall of the carton for holding a chain comprising part of the garage door opener, with the first insert being shaped and arranged to provide a cavity for receiving a U-shaped metal control arm component.

8. A container system as in claim 7, wherein the twin compartment container has a recessed end wall abutting the second insert with the recessed portion of the sidewall lying flush with the recessed portion of the insert for supporting the apertured bar.

9. A compact container system for holding components of a remote controlled electric garage door opener, comprising, in combination:

a. a variable capacity container defining an elongated compartment and means defining a transmitter cavity for holding a transmitter, and flap means movable from a first position enabling the elongated compartment to hold a first sized receiver, to a second position enabling the elongated compartment to hold a second larger sized receiver;

b. a twin compartment container including a first compartment and a second compartment adjacent the first compartment for holding the variable capacity container; and c. a corrugated cardboard carton having a plurality of hinged panels defining end walls and sidewalls for snugly holding both a motor unit and the twin compartment container generally in side-by-side relationship.

10. A compact container system for holding components of a remote controlled electric garage door opener, comprising, in combination:

a. a first container for holding at least one of a transmitter and a receiver;

b. a corrugated cardboard carton having a plurality of hinged equal height panels defining end walls and sidewalls for snugly holding both a motor unit and the first container; and c. an elongated cardboard carton having a top wall defining two longitudinally aligned apertures and a double layered bottom wall for holding an overhead rail, a laminated structure for positioning against the underside of the top wall and defining apertures arranged in vertical alignment with the apertures of the top wall, a handle coupled to the laminated structure and extending upward through the apertures of the laminated structure and top wall, the laminated structure reinforcing the top wall around the handle so as to prevent deformation of the top wall when the handle is pulled.

* * * * *

Disclaimer 4,032,009.—*Robert E. Taylor,* Evanston, Ill. CONTAINER SYSTEM FOR GARAGE DOOR OPENER. Patent dated June 28, 1977. Disclaimer filed Jan. 21, 1981, by the assignee, *Chamberlain Manufacturing Corp.*

Hereby enters this disclaimer to all ten claims of said patent.

[*Official Gazette April 7, 1981.* ]